US010828530B1

(12) United States Patent
Vujicic et al.

(10) Patent No.: US 10,828,530 B1
(45) Date of Patent: Nov. 10, 2020

(54) EXERCISE MACHINE

(71) Applicant: NPD Team, LLC, Tustin, CA (US)

(72) Inventors: Marko Vujicic, Huntington Beach, CA (US); Greg Wallace, Mission Viejo, CA (US); Mark Chiles, Yorba Linda, CA (US)

(73) Assignee: NPD Team, LLC, Tustin, CA (US)

( * ) Notice: Subject to any disclaimer, the term of this patent is extended or adjusted under 35 U.S.C. 154(b) by 49 days.

(21) Appl. No.: 16/294,724

(22) Filed: Mar. 6, 2019

Related U.S. Application Data

(60) Provisional application No. 62/639,448, filed on Mar. 6, 2018.

(51) Int. Cl.

| | |
|---|---|
| ***A63B 22/00*** | (2006.01) |
| ***A63B 69/18*** | (2006.01) |
| ***A63B 21/02*** | (2006.01) |
| ***A63B 21/00*** | (2006.01) |
| *A63B 21/012* | (2006.01) |

(52) U.S. Cl.
CPC ..... *A63B 22/0076* (2013.01); *A63B 21/023* (2013.01); *A63B 21/152* (2013.01); *A63B 21/4035* (2015.10); *A63B 21/4045* (2015.10); *A63B 69/18* (2013.01); *A63B 21/012* (2013.01); *A63B 21/151* (2013.01); *A63B 21/156* (2013.01); *A63B 22/0002* (2013.01); *A63B 22/0087* (2013.01); *A63B 2022/0079* (2013.01); *A63B 2210/50* (2013.01)

(58) Field of Classification Search
CPC . A63B 22/0076; A63B 22/0002; A63B 69/18; A63B 21/023; A63B 21/152; A63B 21/4035; A63B 21/00047; A63B 21/012; A63B 21/018; A63B 21/156; A63B 21/151; A63B 21/4029; A63B 21/4031; A63B 21/4045; A63B 21/4047; A63B 2022/0079; A63B 2022/0084; A63B 2022/0087; A63B 2210/50
See application file for complete search history.

(56) References Cited

U.S. PATENT DOCUMENTS

| | | | | |
|---|---|---|---|---|
| 6,071,215 A * | 6/2000 | Raffo | A63B 21/153 482/57 |
| 8,517,899 B2 * | 8/2013 | Zhou | A63B 69/182 482/138 |
| 10,279,214 B2 * | 5/2019 | Chiang | A63B 22/0076 |

(Continued)

*Primary Examiner* — Megan Anderson
(74) *Attorney, Agent, or Firm* — Eric Karich; Karich & Associates

(57) ABSTRACT

An exercise machine has a base housing, a boom having an elongate rigid body that extends from a proximal end to a distal end, and a pivot mount which pivotally mounts the proximal end of the boom on the base housing such that the boom is able to pivot with respect to the base housing between a rowing configuration wherein the boom is generally horizontal, and a skiing configuration wherein the boom is generally vertical. A seat element is slidably mounted on the boom, and ski handles attached to a ski cable which extend through ski handle stops at the distal end of the boom. A row handle is also attached to a row cable that extends from the base housing. The exercise machine further includes a resistance device, and a transmission system that connects the ski cable and the row cable to the resistance device.

12 Claims, 6 Drawing Sheets

(56) References Cited

U.S. PATENT DOCUMENTS

| | | | | |
|---|---|---|---|---|
| 10,449,409 | B2 * | 10/2019 | Hamilton | A63B 21/012 |
| 2016/0001123 | A1 * | 1/2016 | Parrish, Jr. | A63B 22/0076 482/72 |
| 2020/0171346 | A1 * | 6/2020 | Chen | A63B 22/04 |

* cited by examiner

EXERCISE MACHINE

CROSS-REFERENCE TO RELATED APPLICATIONS

This application for a utility patent claims the benefit of U.S. Provisional Application No. 62/639,448, filed Mar. 6, 2018.

BACKGROUND OF THE INVENTION

Field of the Invention

This invention relates generally to exercise machines, and more particularly to an exercise machine that combines the functionality of a ski exercise machine and a rower.

Description of Related Art

The prior art teaches ski exercise machines, which include a pair of handles mounted on a vertical boom, so they may be pulled down to simulate a skiing exercise. The prior art also teaches a rower which includes a horizontal boom having a sliding seat upon which the user may slide while engaging in a simulated rowing exercise.

The prior art teaches a ski exercise machine alone, and it teaches a rower alone. However, the prior art does not teach a single device that may provide both exercises in a single machine, thereby conserving floor space in a gym, home, or other location. The present invention fulfills these needs and provides further advantages, as described in the following summary.

SUMMARY OF THE INVENTION

The present invention teaches certain benefits in construction and use which give rise to the objectives described below.

The present invention provides an exercise machine, which includes a base housing, a boom having an elongate rigid body that extends from a proximal end to a distal end, and a pivot mount which pivotally mounts the proximal end of the boom on the base housing. The boom is then able to pivot with respect to the base housing between a rowing configuration, wherein the boom is generally horizontal, and skiing configuration, wherein the boom is generally vertical. A seat element is slidably mounted on the boom, and ski handles are attached to a ski cable which extend through ski handle stops at the distal end of the boom. A row handle is also attached to a row cable that extends from the base housing. The exercise machine further includes a resistance device, and a transmission system that connects the ski cable and the row cable to the resistance device.

A primary objective of the present invention is to provide an Exercise Machine having advantages not taught by the prior art.

Another objective is to provide an exercise machine that has a boom capable of pivoting to provide the functionality of both a ski exercise machine and a row exercise machine.

A further objective is to provide an exercise machine that has a pulley system adapted for both ski handles and row handles.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an exercise machine 10 that may be configured in either a skiing configuration or a rowing configuration.

Figure 1:
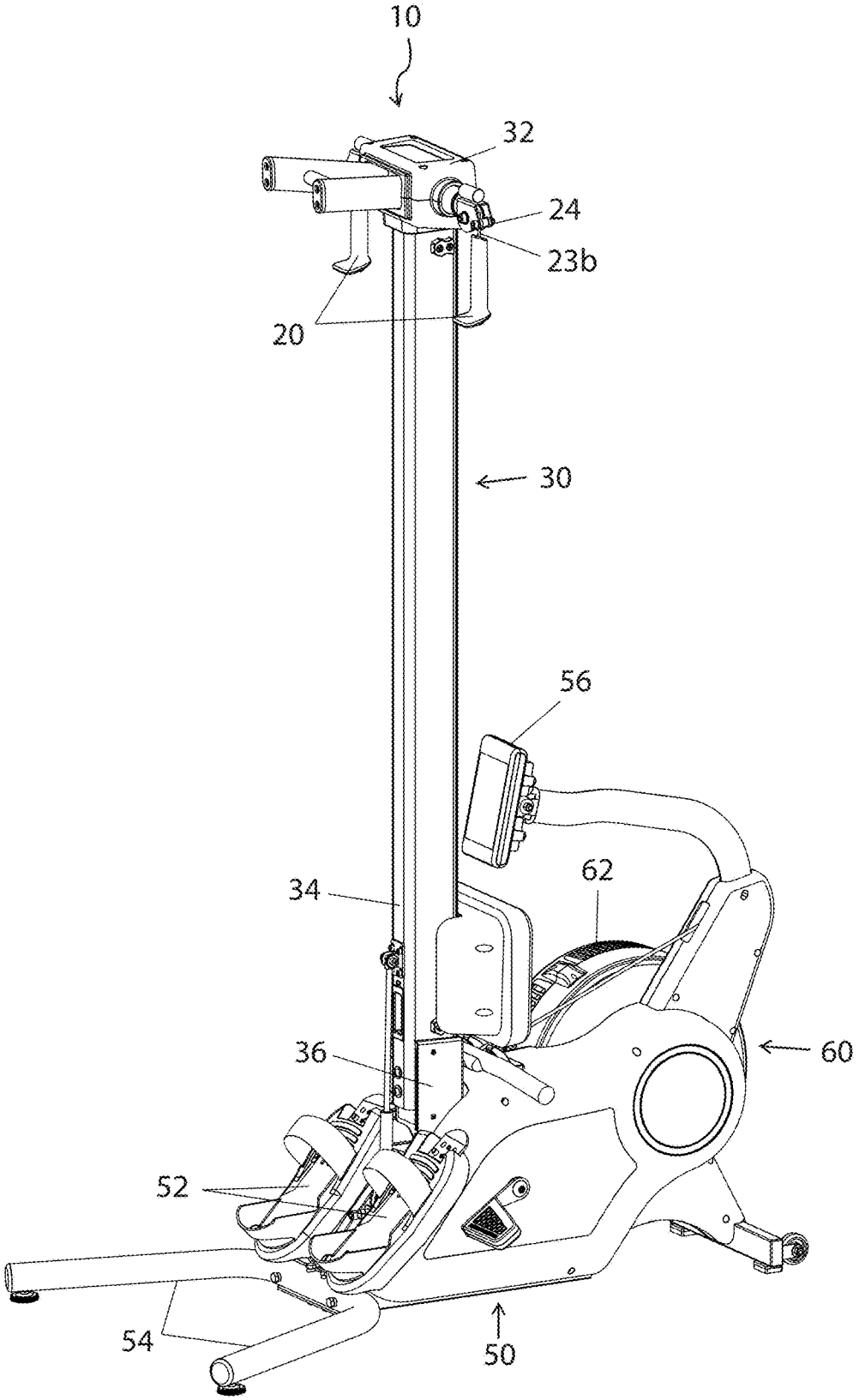
FIG. 1 is a perspective view of an exercise machine according to one embodiment of the present invention, the exercise machine being in a ski configuration.
Figure 2:
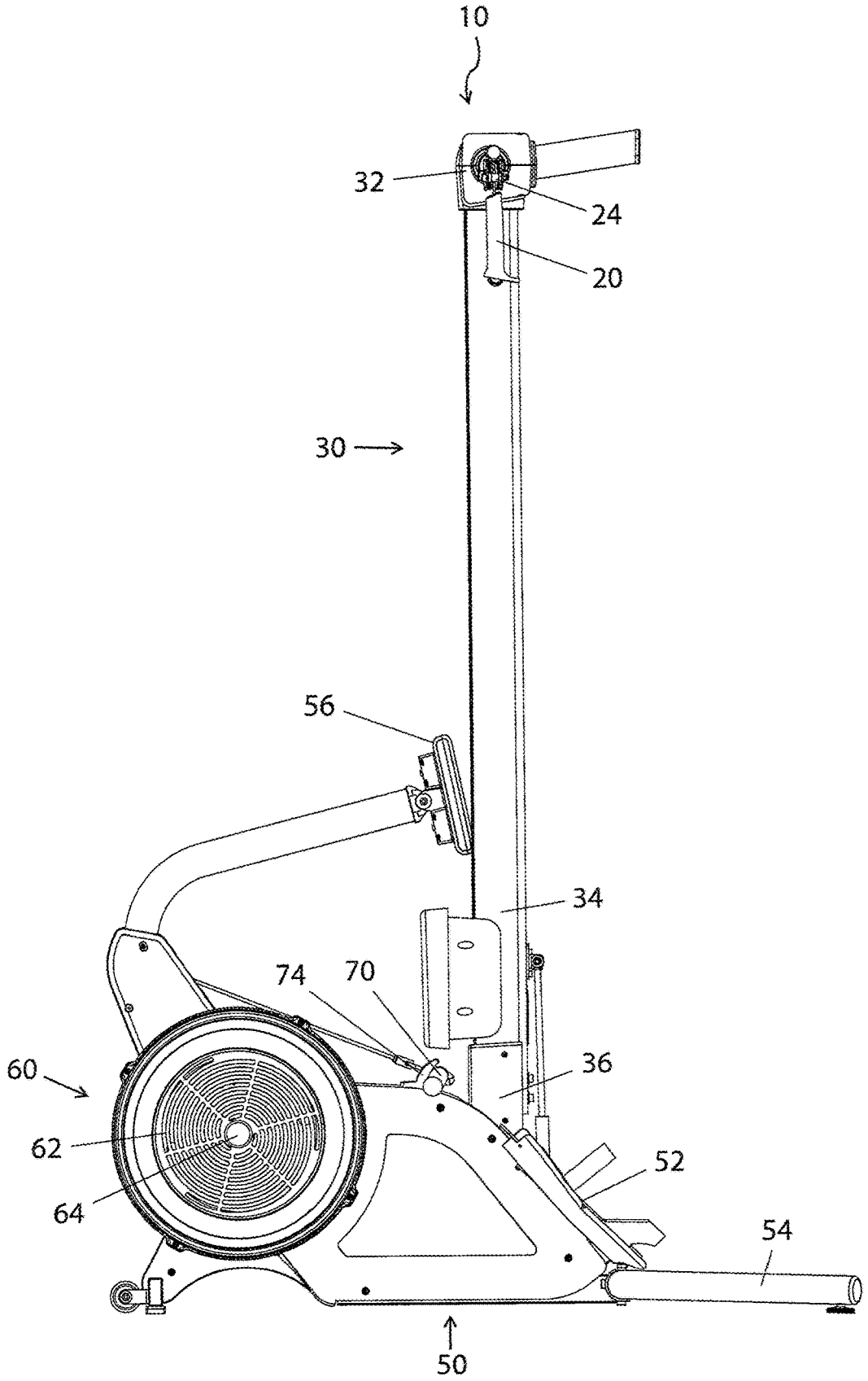
FIG. 2 is a side elevational view thereof.

FIG. 1 is a perspective view of one embodiment of the exercise machine 10, being shown in a ski configuration. FIG. 2 is a side elevational view thereof. As shown in FIGS. 1-2, the exercise machine 10 includes a pair of ski handles 20 that are attached to a ski cable 22 (best shown in FIG. 4, and alternatively 5*a* or 5*b*) for performing ski exercises wherein the user grasps the ski handles 20 and pulls them downwardly against the resistance exerted by the ski cable 22, as described in greater detail below.

Figure 4:
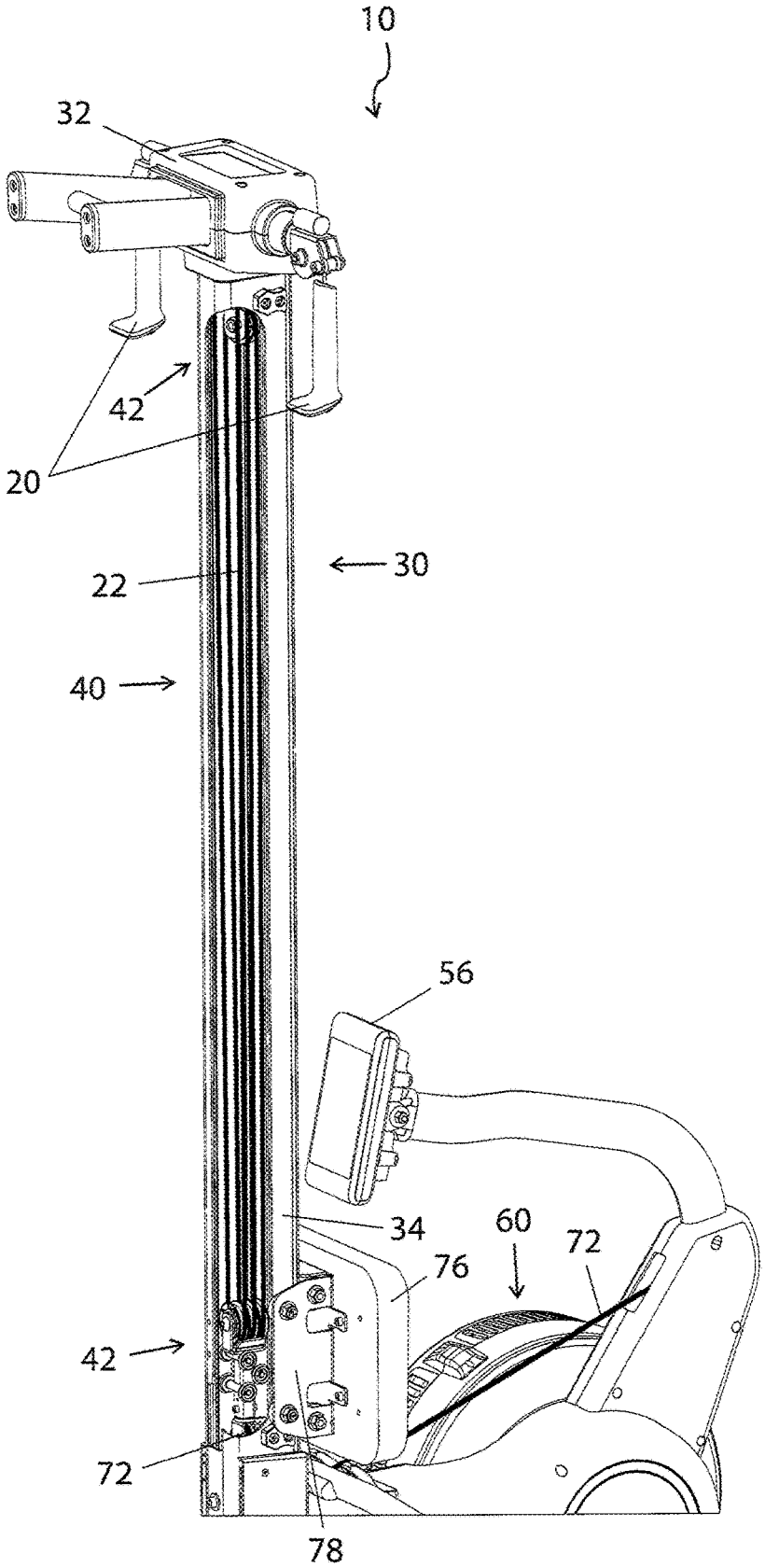
FIG. 4 is a perspective view of the exercise machine in the ski configuration, partially broken away to illustrate a pulley system connected with ski handles.

The ski handles 20 are held in a raised position at a distal end 32 of a boom 30. The boom 30 may be in any form of a rigid, elongate structure that holds the ski handles 20 a suitable height above the user. The distal end 32 of the boom 30 further includes ski handle stops 24, to prevent the ski handles 20 from receding into the boom 30. As shown in FIG. 4, in this embodiment, the boom 30 is a hollow construction that houses the ski cable 22 and a row cable 72 within a pulley system 42 of a transmission 40, so that they are not exposed, the transmission 40 being described in greater detail below.

The boom 30 is pivotally mounted, at a proximal end 34, to a pivot mount 36 which pivotally mounts the boom 30 on a base housing 50 such that the boom 30 is able to pivot with respect to the base housing 50 between a rowing configuration (shown in FIG. 3), wherein the boom 30 is generally horizontal, and the skiing configuration (shown in FIG. 1), wherein the boom 30 is generally vertical. The base housing 50 includes a pair of foot engagement structures 52 for receiving the user's feet while performing the rowing exercises, as discussed below. Extending from the base housing 50 are supporting legs 54, which stabilize the exercise machine 10 during use. The base housing 50 further includes a resistance device 60 for providing resistance to the ski cable 22, as well as components used in the rowing configuration, as described in greater detail below. In this embodiment, the resistance device 60 includes an air displacement fan 62 which is operated by a one way clutch 64 (shown in FIG. 5*a*), as described in greater detail below. The fan 62 is operably mounted on the base housing 50, and attached to the transmission 40, described further below. While one embodiment of the resistance device 60 is the fan 62 shown and described, alternative forms of resistance known to those skilled in the art may also be used, e.g., water or magnetic displacement mechanisms, etc., which should be considered within the scope of the present invention.

In this embodiment, a computer display 56 extends from the base housing 50 for displaying feedback (e.g., calories burned, etc.) or entertainment (e.g., an instructional video) to the user. The base housing 50 may further include additional, optional features for providing data to the user, as is well known in the art, and should be considered within the scope of the present invention.

Figure 3:
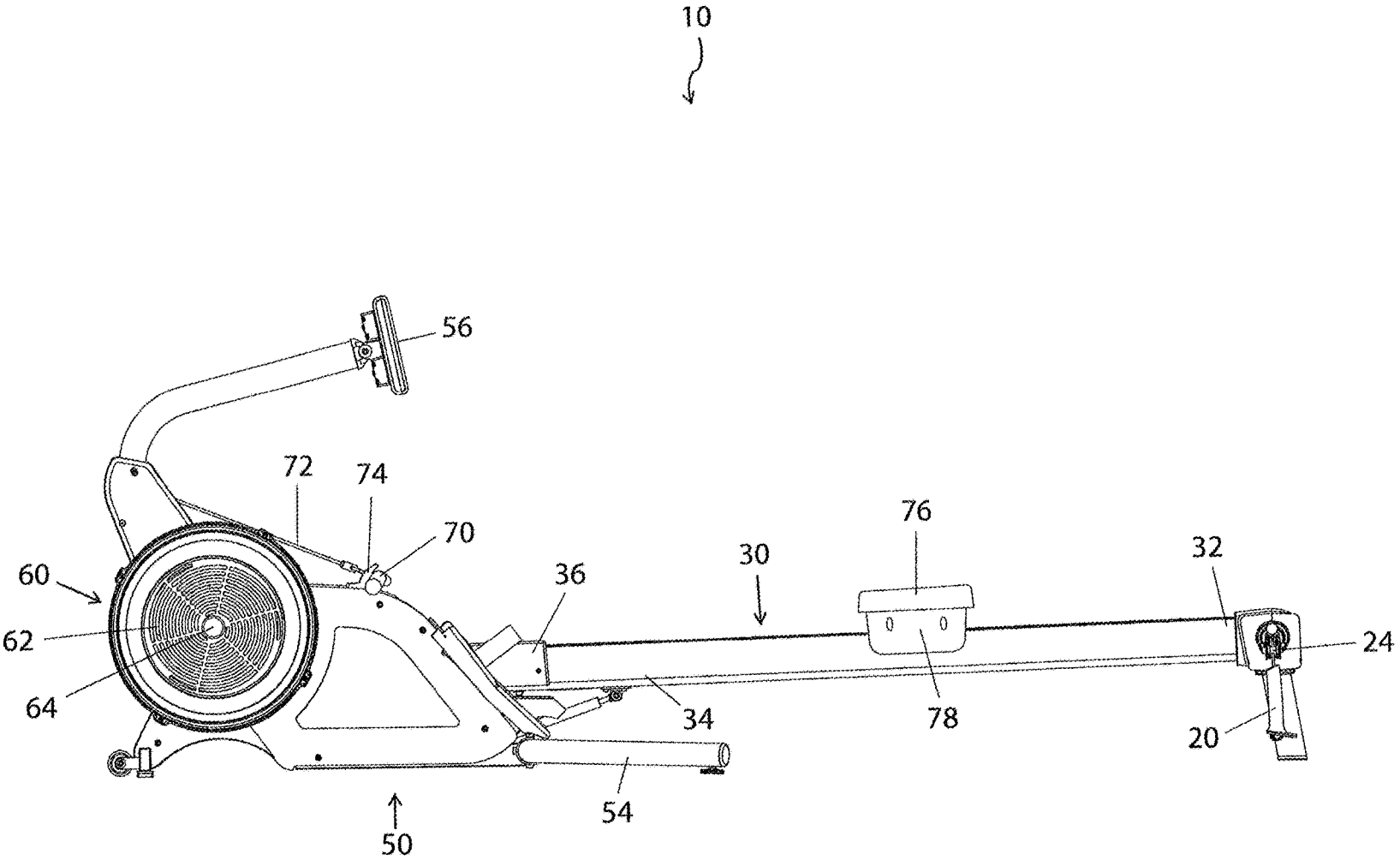
FIG. 3 is side elevational view of the exercise machine in a rowing configuration.

FIG. 3 is side elevational view of the exercise machine 10 in a rowing configuration. As shown in FIG. 3, the boom 30 may be lowered to a horizontal position via the pivot mount 36, so that a seat element 76 is positioned upright to receive the user thereupon in a seated position. The seat element 76 is slidably mounted on the boom 30 with sliders 78 so that when the user is seated on the seat element 76, he or she may slide forward and back to perform rowing exercises using a row handle 70 attached to the row cable 72. The sliders 78 may be any suitable mechanism known in the art, such as wheels guided by channels within the boom 30, etc.

A handle receiver 74 may be mounted on the base housing 50 to catch and hold the row handle 70 and hold it for easy access by the user while not in use. In this embodiment, the handle receiver 74 is in the form of a pair of hooks; however, in alternative embodiments, other forms of attachment mechanisms and structures (e.g., receiving structures, straps, etc.) may be devised by those skilled in the art to hold the row handle 70 in place when not in use, and such alternative structures should be considered within the scope of the current invention. The row cable 72 is operably connected to the transmission 40, mentioned above, and thus to the resistance device 60, for providing resistance to the row cable 72.

FIG. 4 is a perspective view of the exercise machine 10 in the ski configuration, partially broken away to illustrate the transmission 40 for connecting the row cable 72 and the ski cable 22 to the resistance device 60. In this embodiment, the transmission 40 includes the pulley system 42 that connects the fan 62 with the row handle 70 and the pair of ski handles 20 within the hollow boom 30.

Figure 5A:
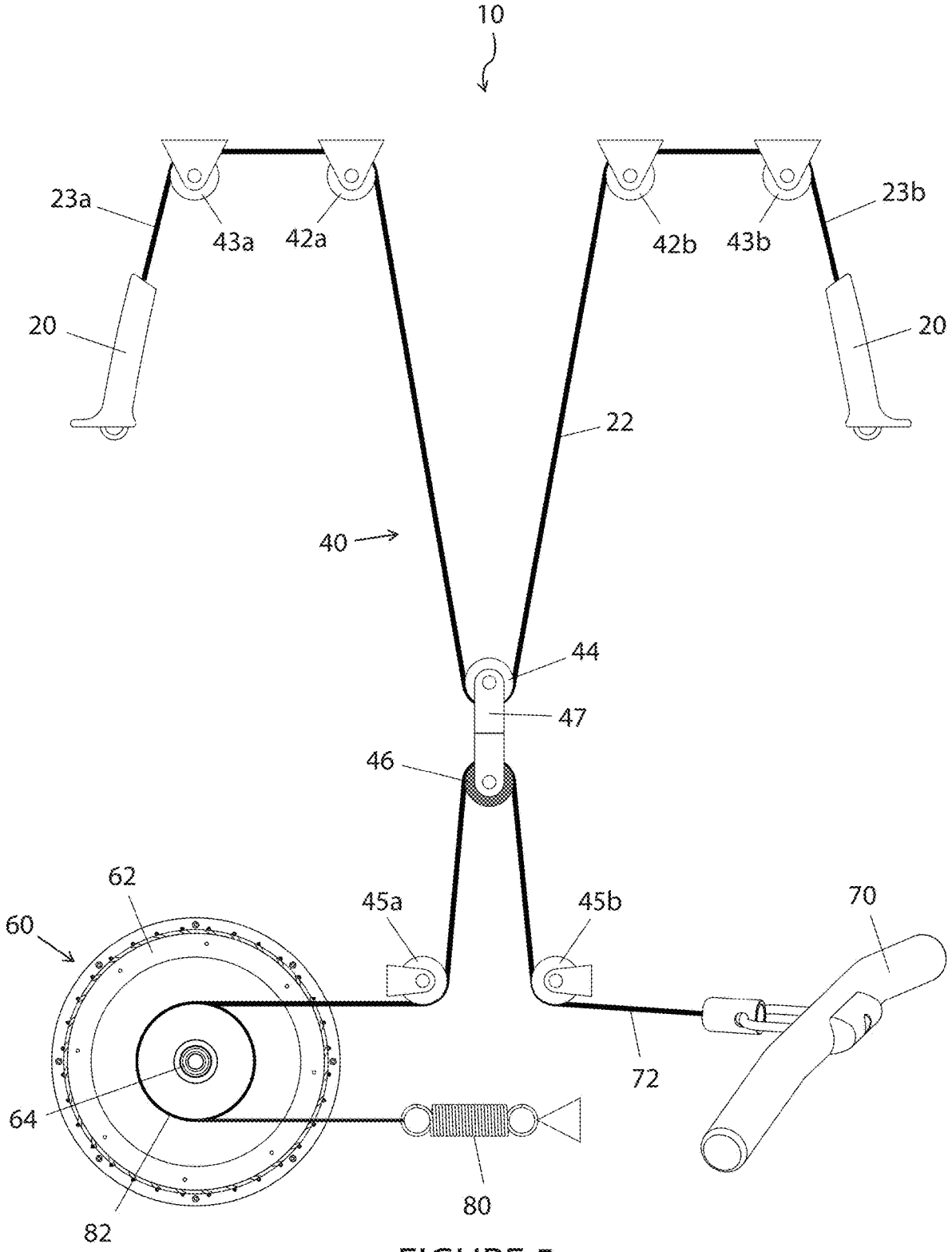
FIG. 5A is a diagram of one embodiment of the pulley system of FIG. 4, illustrating how a row handle and the ski handles are attached to a resistance fan via the pulley system.

FIG. 5A is a diagram of one embodiment of the pulley system 42 of FIG. 4, illustrating how the row handle 70 and the ski handles 20 may be attached to the fan 62 via the pulley system 42. As shown in FIG. 5A, in the first embodiment the transmission 40 includes the single ski cable 22 that passes through a first movable pulley 44, from one handle to another. The row cable 72 passes through an opposing pulley 46, and is connected to the fan 62.

In one embodiment of FIG. 5A, a first end 23*a* is attached to one of the pair of ski handles 20, and the second end 23*b* is attached to the other of the pair of ski handles 20. The ski cable 20 extends through ski handle stops 24 (shown in FIG. 1) at the distal end 32 of the boom 30. In addition, first and second top pulleys 42*a* and 42*b* are positioned adjacent the distal end 32 of the boom 30. A top movable pulley 44 is positioned within or adjacent the boom 30, and a bottom movable pulley 46 fixedly mounted to the top movable pulley with a pulley housing 47. In this embodiment, the ski cable 20 extends from the first end 23*a*, through one of the ski handle stops 24, around the first top pulley 42*a*, around the top movable pulley 44, around the second top pulley 42*b*, and then back out through the other ski handle stops 24, to the second end 23*b*. In one embodiment, the ski cable 20 may further extend around first and second additional pulleys 43*a* and 43*b* that are each laterally spaced from the top pulleys 42*a* and 42*b*, respectively, for mounting the ski handles 20 at suitable positions relative to the boom 30.

Those skilled in the art may add additional features to further facilitate this construction, and such additions within the skill of the art should also be considered within the scope of the present invention.

As shown in FIG. 5A, the row handle 70 is attached to the row cable 72 which extends around a first bottom pulley 45*a*, around the bottom movable pulley 46, and around a second bottom pulley 45*b*, to where it is connected to the resistance device 60. In this manner, when the row handle 70 is pulled, the row cable 72 directly pulls on the resistance device 60, since the ski handles 20 do not allow movement of the bottom movable pulley 46. The ski handles 20, on the other hand, pull on the top movable pulley 44, which in turn (via the bottom movable pulley 46) pull upon the row cable 72, to pull the resistance device 60.

Figure 5B:
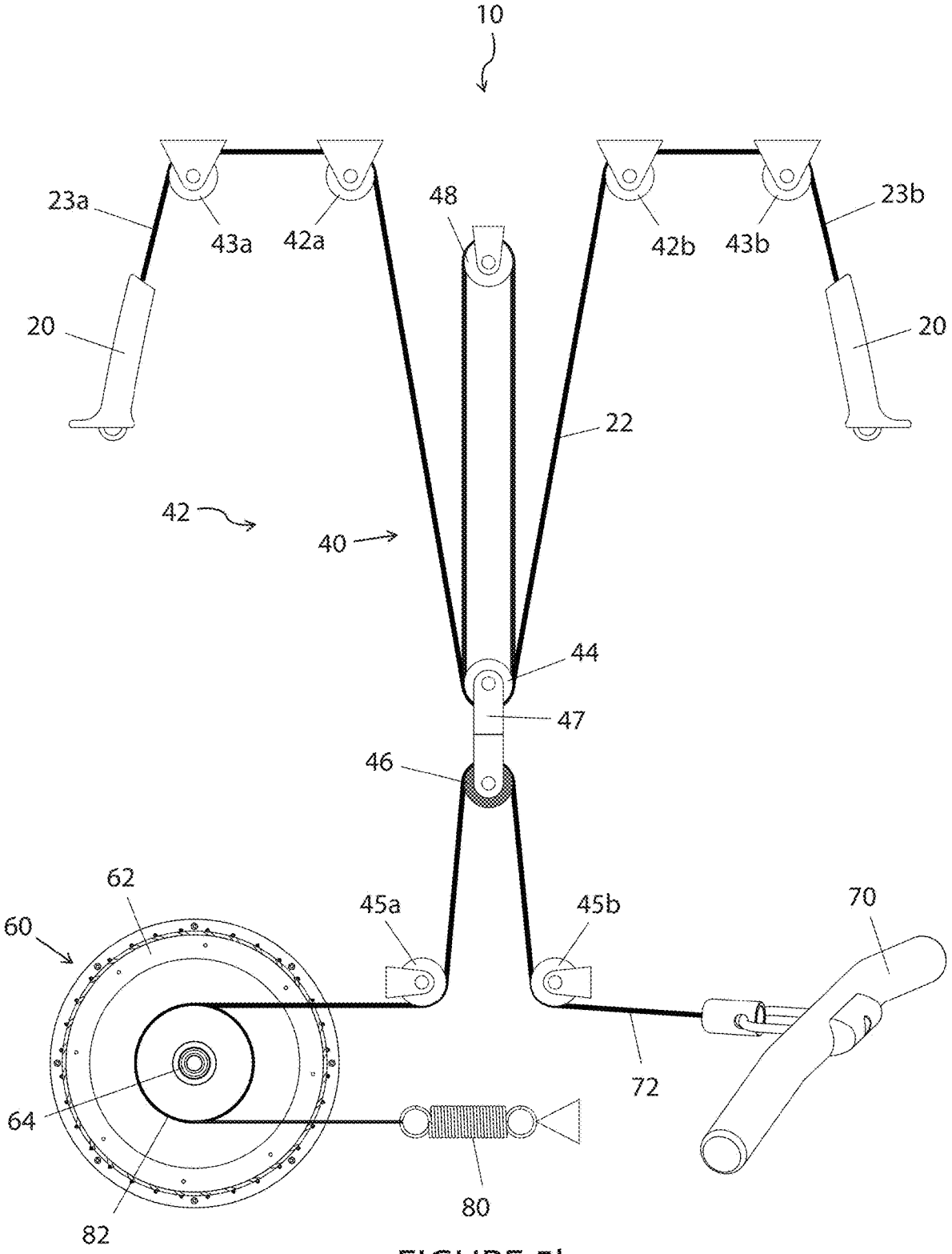
FIG. 5B is a diagram of another embodiment of the pulley system of FIG. 4, illustrating a second embodiment of how a row handle and the ski handles are attached to a resistance fan via the pulley system.

FIG. 5B is a diagram of another embodiment of the pulley system 42 of FIG. 4, illustrating a second embodiment of how the row handle 70 and the ski handles 20 are attached to the fan 62 via the pulley system 42. As shown in FIG. 5B, the ski cable 22 may pass through one or more additional fixed pulleys 48 in combination with one or more top moveable pulleys 44, to achieve a varied gear ratio to adjust the force ratio-metrically between the ski handles and the row handle. This enables the fan 62 to provide resistance to the row handle 70 and to the ski handles 20, enabling exercises using these handles.

The system 10 further has a recoil device 80 within the base housing 50 that provides force to return the cables 72 and 22 to their respective starting positions after each use. In the embodiment of FIGS. 5*a* and 5*b*, the recoil device 80 is in the form of a coiled spring, but in other embodiments may comprise a different recoil mechanism known in the art (e.g., a resilient band, other form of spring, etc.).

In this embodiment, the cable 72 wraps around a spool 82 to drive the resistance device 60. In other embodiments, the resistance device 60 may be driven with a chain and sprockets, toothed belt, frictional belt, or other means known to those skilled in the art.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. An exercise machine comprising:

a base housing;

a boom having an elongate rigid body that extends from a proximal end to a distal end;

a pivot mount which pivotally mounts the proximal end of the boom on the base housing such that the boom is able to pivot with respect to the base housing between a rowing configuration wherein the boom is horizontal, and a skiing configuration wherein the boom is vertical;

a seat element which is slidably mounted on the boom;

ski handles attached to a ski cable which extends through ski handle stops at the distal end of the boom;

a row handle attached to a row cable that extends from the base housing;

a resistance device; and a transmission system that connects the ski cable and the row cable to the resistance device.

2. The exercise machine of claim 1, further comprising a handle receiver fixedly mounted on the base housing for locking the position of the row handle with respect to the resistance device.

3. The exercise machine of claim 2, wherein the handle receiver includes a pair of hooks that extend from the base housing.

4. The exercise machine of claim 1, wherein the boom is hollow to house the ski cable.

5. The exercise machine of claim 1, wherein the resistance device comprises an air displacement fan which is operably attached to the transmission system via a one-way clutch.

6. The exercise machine of claim 1, wherein the transmission system further comprises a pulley system which connects the resistance device with the ski handles and the row handle.

7. An exercise machine comprising:

a base housing;

a boom having an elongate rigid body that extends from a proximal end to a distal end;

a pivot mount which pivotally mounts the proximal end of the boom on the base housing such that the boom is able to pivot with respect to the base housing between a rowing configuration wherein the boom is horizontal, and a skiing configuration wherein the boom is vertical;

a seat element which is slidably mounted on the boom;

a pair of ski handles;

a ski cable having a first end and a second end, the first end being attached to one of the pair of ski handles, and the second end being attached to the other of the pair of ski handles, the ski cable extends through ski handle stops at the distal end of the boom into the boom;

first and second top pulleys positioned adjacent the distal end of the boom;

at least one top movable pulley positioned within the boom at least one bottom movable pulley fixedly mounted to the top movable pulley with a pulley housing;

wherein the ski cable extends from the first end, through one of the ski handle stops, around the first top pulley, around the top movable pulley, around the second top pulley, and then back out through the other ski handle stops, to the second end;

a row handle attached to a row cable that extends around a first bottom pulley, around the bottom movable pulley, and around the second bottom pulley, to a resistance device.

8. The exercise machine of claim 7, further comprising a handle receiver fixedly mounted on the base housing for locking the position of the row handle with respect to the resistance device.

9. The exercise machine of claim 8, wherein the handle receiver includes a pair of hooks that extend from the base housing.

10. The exercise machine of claim 7, wherein the boom is hollow to house the ski cable.

11. The exercise machine of claim 7, wherein the resistance device comprises an air displacement fan which is operably attached to the row cable via a one-way clutch.

12. The exercise machine of claim 7, further comprising an additional fixed pulley, and wherein the ski cable extends from the top movable pulley around the additional fixed pulley.

* * * * *